US007097164B2

(12) United States Patent
Vick et al.

(10) Patent No.: US 7,097,164 B2
(45) Date of Patent: Aug. 29, 2006

(54) LIMITER CAP FOR CARBURETOR

(75) Inventors: Christian Vick, Winsen (DE); Carsten Ziegs, Hamburg (DE)

(73) Assignee: Dolmar GmbH, Hamburg (DE)

( * ) Notice: Subject to any disclaimer, the term of this patent is extended or adjusted under 35 U.S.C. 154(b) by 0 days.

(21) Appl. No.: 11/050,018

(22) Filed: Feb. 2, 2005

(65) Prior Publication Data

US 2005/0173816 A1 Aug. 11, 2005

(30) Foreign Application Priority Data

Feb. 5, 2004 (DE) ..... 20 2004 001 774 U
Aug. 17, 2004 (DE) ..... 20 2004 012 860 U

(51) Int. Cl.
*F02M 19/04* (2006.01)

(52) U.S. Cl. ..... 261/71; 137/382; 261/DIG. 38; 261/DIG. 84

(58) Field of Classification Search ..... 261/71, 261/DIG. 38, DIG. 84; 137/382, 382.5; 411/301, 412, 542
See application file for complete search history.

(56) References Cited

U.S. PATENT DOCUMENTS 5,322,645 A 6/1994 Hammett et al. ..... 261/71
5,525,267 A 6/1996 Araki ..... 261/71
5,635,113 A * 6/1997 Walsh et al. ..... 261/71
5,667,734 A * 9/1997 Ohgane ..... 261/71
5,707,561 A * 1/1998 Swanson ..... 261/71
5,955,007 A * 9/1999 Koizumi et al. ..... 261/67
5,961,896 A 10/1999 Koizumi et al. ..... 261/67
5,984,281 A * 11/1999 Hacker et al. ..... 261/71
6,234,458 B1 5/2001 Gerhardy ..... 261/71
6,302,384 B1 * 10/2001 Douyama ..... 261/71
6,467,757 B1 * 10/2002 Douyama ..... 261/71
6,491,288 B1 * 12/2002 Nagata et al. ..... 261/71
2002/0070466 A1 * 6/2002 Burns ..... 261/71

FOREIGN PATENT DOCUMENTS

DE 42 10 553 A1 10/1993
DE 198 14 683 A1 6/1999
DE 100 44 025 A1 3/2002
JP 53-14234 * 2/1978 ..... 137/382.5

* cited by examiner

*Primary Examiner*—Richard L. Chiesa
(74) *Attorney, Agent, or Firm*—Kelly Lowry & Kelley, LLP

(57) ABSTRACT

In order to improve a limiter cap (300; 300') for limiting the adjustability of at least two set screws or valves (200), which are arranged side by side, with each set screw or valve (200) including at least one retaining nose or stop leg (240), extending in the transition area between the screw head (210) and the screw needle or valve needle (220) in a ring shape around the external circumference of the screw needle or valve needle (220), in particular for limiting the adjustment of the fuel flow through a carburetor (400; 400'), in such a way that inadvertently pushing the limiter cap onto the screw needle thus prematurely blocking said screw needle, already at the time when the (basic) carburetor adjustment takes place, is safely prevented, it is proposed that the limiting cap (300; 300') is attached to each of the set screws (200) in particular in a way so as to be self-attaching, and/or in particular such that the limiter caps (300; 300') engage each other with locking action, and/or without any further auxiliary means or without any further supplementary part.

14 Claims, 7 Drawing Sheets

LIMITER CAP FOR CARBURETOR

TECHNICAL FIELD

The present invention relates to a limiter cap.

STATE OF THE ART

From DE 100 44 025 A1 an adjusting screw for regulating the fuel/air mixture of a carburetor is known. This adjusting screw or set screw is used for precise and quick adjustment of the fuel flow through a carburetor, with the use of fully-automatically operating measuring cabins.

Furthermore, from DE 42 10 553 A1 an adjustment prevention device for an adjusting screw on a carburetor is known, which ensures that the end stops of the adjusting screw, which end stops delimit adjustment travel, cannot be removed without destroying the adjustment prevention device. This adjustment prevention device thus ensures that any manipulation of the fuel flow that is outside the permitted limit can easily be detected and can safely be proven by the supervisory authorities.

However, since this adjustment prevention device disclosed in DE 42 10 553 A1 for dual-stage installation of a limiter cap in a carburetor needs at least one supplementary part, in particular at least one retaining clip, correct setting of the fuel flow through the carburetor during manufacture as well as during installation of said carburetor in an internal combustion engine is rendered difficult.

This supplementary part, in particular this retaining clip, is used to attach the limiter cap in the first installation position in a captive way on the set screw. However, as a result of this supplementary part, in particular of this retaining clip, installation of the limiter cap as well as the setting of the fuel throughflow by the manufacturer is made considerably more difficult, not least because according to DE 42 10 553 A1 three parts are required, which is disadvantageous.

Since after its installation the adjustment prevention device cannot be removed without damage, the carburetor becomes unusable and must be replaced if the adjustment prevention device was inadvertently installed before the fuel throughflow had been optimally adjusted.

From DE 198 14 683 A1 a limiter cap of the type mentioned in the introduction is known. For its attachment to the screw needle or valve needle in a first installation position this limiter cap inconveniently also requires a retaining clip.

Such known limiter caps (compare for example also the above mentioned DE 42 10 553 A1 from the state of the art), which are installed prior to setting the load setting screw or H(igh)-needle and prior to setting the idle adjusting screw or L(ow)-needle, usually on a part of the carburetor or on the carburetor itself, are made up of many different components, which makes it considerably more difficult for the manufacturer to install the limiter cap and to adjust the fuel throughflow.

PRESENTATION OF THE INVENTION: TASK, SOLUTION, ADVANTAGES

Using the above-mentioned disadvantages and shortcomings as a basis and taking into account the outlined state of the art, it is the object of the present invention to improve a limiter cap of the type mentioned in the introduction to the extent that inadvertently pushing the limiter cap onto the screw needle and thus prematurely blocking said screw needle, already at the time when the (basic) carburetor adjustment takes place, is safely prevented.

This object is met by a limiter cap of the present invention.

Consequently, the uniform limiter cap can be clipped to or locked to any of the set screws, i.e. identical caps are provided for the needles, in particular two identical caps for the two needles.

According to the invention there is thus an advantage in that the limiter cap can be clipped onto the needle without a supplementary part, in particular without a retaining clip, so that installation of the limiter cap and adjustment of the fuel throughflow are both made significantly easier by the present invention.

In an expedient embodiment of the present invention, two set screws or two needles are provided, in particular an idle adjusting screw or L(ow)-needle; and a load setting screw or H(igh)-needle which are arranged side by side.

If the limiter cap, being such a uniform cap, is pushed or clipped onto the H(igh)-needle and onto the L(ow)-needle, any inadvertent pushing or clipping of the limiter cap onto the needles already at the (basic) carburetor adjustment stage, which action would lead to premature blocking of these needles, can be prevented.

Expediently, the interior circumference of the limiter cap comprises an inward pointing projection which in the first installation position, by interaction with and in particular by resting against a retaining nose (=so-called stop leg) which in the transition region between the screw head and the screw needle or valve needle extends in a ring shape around the outer circumference of the screw needle or valve needle, prevents any axial movement of the limiter cap in the direction of the tip of the screw needle or valve needle, and thus prevents any premature and unintended transition of the limiter cap from the first installation position to the second installation position.

Advantageously, in this first installation position in which the screw needles or valve needles are rotatable relative to the limiter cap without the respective limiter cap rotating as well, at least one guiding nose of the limiter cap can be spread outward by at least one retaining nose of the valve needle so that the guiding nose can interact with at least one connection groove of the adjacent cap which is of identical design.

In this way the (limiter) caps cannot rotate or move out of adjustment when the needles (of the screws or valves) are rotated or adjusted. The caps thus adjoin each other at the contact position of the two guiding noses as well as at the contact positions between the adjustment prevention devices of the caps and the respective other caps.

In an advantageous embodiment of the present invention at least one locking means, in particular at least one serration profile, at least one knurl or the like, of the screw needle or the valve needle interacts in the second installation position with at least one complementary locking means, in particular with at least one complementary serration profile, with at least one complementary knurl or the like, of the limiter cap. In particular, the locking means of the screw needle or valve needle engages the complementary locking means of the limiter cap so as to ensure reliable locking of the set screw with the limiter cap in a way that is secure against rotation and loss.

Advantageously, in the second installation position, i.e. after the limiter cap has been pushed onto or clipped onto the locking means, the guiding nose of the limiter cap jumps below the retaining nose and enters the connection groove of the adjacent cap either only slightly or no longer at all. The caps are thus unlocked and can be adjusted according to their adjustment or readjustment options of at least one of the adjustment prevention devices allocated to the limiter cap. This means that any adjustment or readjustment options are only possible within the framework of an adjustment angle which is determined by the adjustment prevention device, in particular by at least one end stop.

In order to accommodate a tool, in particular an electronically controlled tool, for example a screwdriver, according to an advantageous improvement of the present invention the following is/are inset into the screw head at its side facing away from the screw needle:

at least one slot, known per se (compare DE 100 44 025 A1), which tapers off towards the side of the screw needle, wherein said slot extends across the diameter of the screw head, or two slots, known per se (compare DE 100 44 025 A1), which taper off towards the side of the screw needle and are arranged crosswise in relation to each other, wherein said slots extend across the diameter of the screw head.

According to an advantageous embodiment, the screw head projects from the end region of the limiter cap, which end region faces away from the screw needle. In other words, the screw head projects across the border edge of the limiter cap, which border edge faces away from the screw needle, so that the set screw cannot already be locked to the limiter cap while in the first installation position or in the first snap-in position, i.e. it cannot in the first installation position already be moved over to the second installation position or second snap-in position.

For ease of introducing a tool, in particular an electronically controlled tool, for example a screwdriver, the limiter cap preferably comprises at least one leading-in aid (compare DE 100 44 025 A1), in particular at least one leading-in funnel, at least one leading-in land or at least one ring. This leading-in aid is attached to the side of the limiter cap which side faces away from the screw needle or valve needle.

This prevents the limiter cap from inadvertently being pushed or clipped onto the needles already at the time when the (preliminary or basic) carburetor adjustment takes place, and thus prevents premature blocking of said needles. After the needles have been adjusted, the limiter cap(s) is/are then—in a second snap-in position, i.e. when they have reached the second installation position—by way of the locking means connected to the needle in a way that they cannot rotate, and in a way so as to be captured by way of an inward pointing projection of the limiter cap.

Furthermore, the present invention comprises an adjustment means, in particular for adjusting the fuel flow through a carburetor, comprising:

at least one rotatable set screw or at least one rotatable valve with screw head and with screw needle or valve needle, as well as at least one limiter cap according to the type described above.

Furthermore, the present invention relates to a carburetor, in particular a carburetor associated with a two-stroke motor or a four-stroke motor, comprising:

at least one limiter cap of the type explained above, and/or at least one adjustment means of the type explained above.

In the carburetor, the fed-in fuel quantity is adjusted at idle by way of the idle needle valve (so-called idle adjusting screw or L(ow) needle); and during full load or part load by way of the load needle valve (so-called load setting screw or H(igh) needle).

Advantageously, the respective valve needle is cylindrical with a thread; with the screw head at one end and the needle tip at the other end; wherein this needle tip is accommodated in an aperture of the carburetor housing.

For setting the fuel flow, each screw needle or valve needle is screwed into a fuel flow channel of the carburetor, and in this way the optimum flow rate, i.e. the fuel flow, is set to a specified desired value. Before the carburetor is installed in an internal combustion engine, in particular in a two-stroke motor or in a four-stroke motor, said carburetor can be preadjusted using a flow meter.

After installation, fine adjustment of the valves will take place in order to optimally reflect the fuel requirement of the internal combustion engine. Subsequent unsuitable "over"-adjustment of the fuel flow (either too rich or too lean) by the operator or user of the internal combustion engine is prevented in that the limiter cap is attached to the head of each valve needle.

The present invention furthermore relates to an internal combustion engine, in particular to a two-stroke motor or a four-stroke motor, comprising at least one carburetor of the type explained above.

The present invention furthermore relates to tools or work equipment, in particular to a small vehicle, a motor (chain) saw, a brush cutter or a lawnmower, comprising at least one internal combustion engine, in particular at least one two-stroke motor or at least one four-stroke motor, of the type explained above.

The present invention, i.e. the limiter cap of the type explained above and/or the set screw of the type explained above and/or the adjustment means of the type explained above, can for example be used:

in a carburetor of the type explained above, and/or in an internal combustion engine, in particular in a two-stroke motor or in a four-stroke motor of the type explained above of at least one tool or machine, in particular of at least one small vehicle, at least one motor (chain) saw, at least one brush cutter or at least one lawnmower.

BRIEF DESCRIPTION OF THE DRAWINGS

As has already been mentioned above, there are various options for advantageously applying and improving the present invention. Reference is made to the further embodiments, characteristics and advantages of the present invention as they are explained in more detail by the example of two embodiments with reference to FIGS. 1A to 6.

The following are shown.

Identical or similar embodiments, elements or characteristics are designated by identical reference characters in FIGS. 1A to 6.

THE BEST WAY TO IMPLEMENT THE INVENTION

Figure 4:
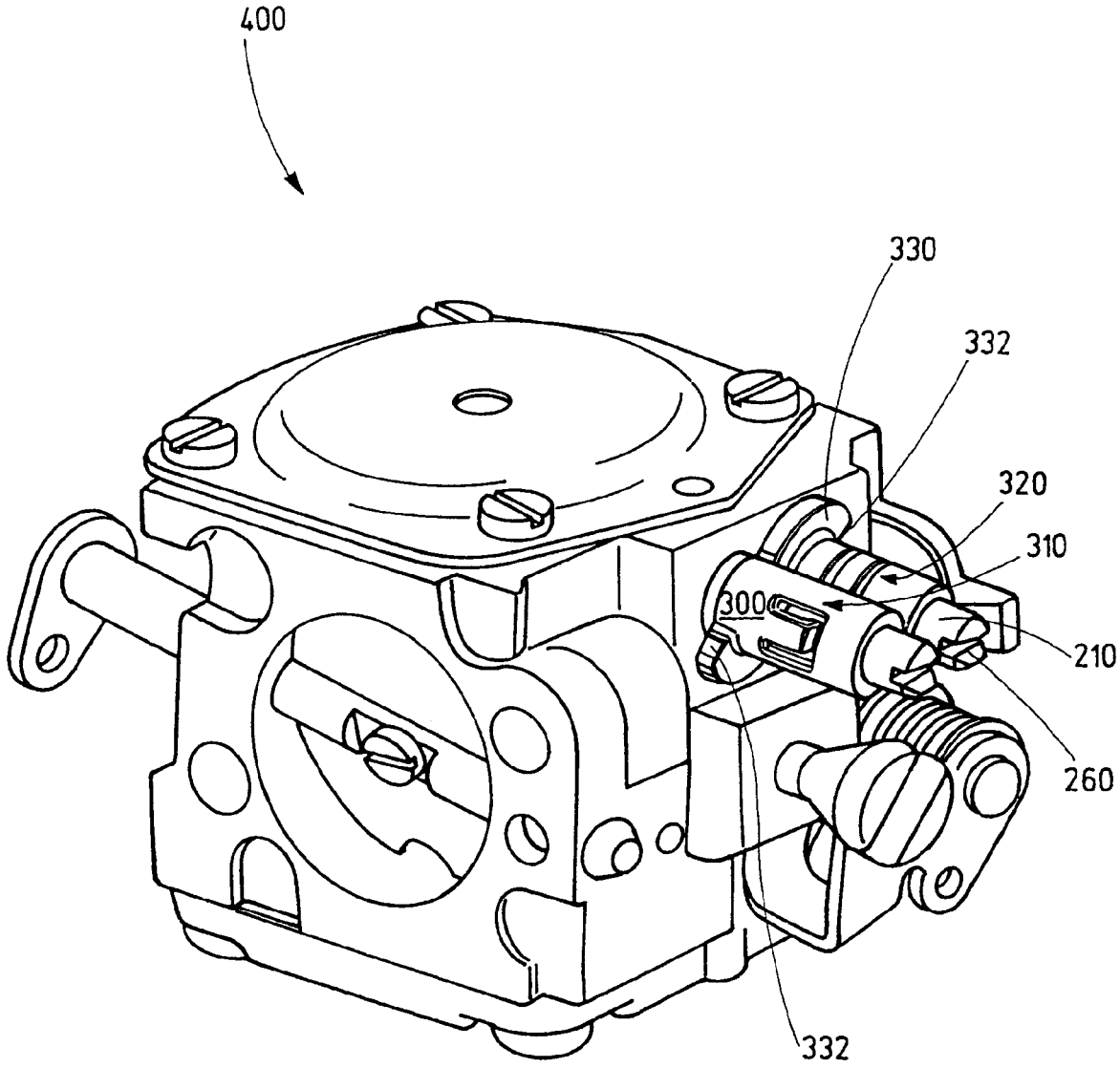
FIG. 4 a perspective view of a first embodiment of a carburetor in which the adjustment means shown in FIG. 1A to FIG. 1D is installed according to the second installation position.
Figure 5:
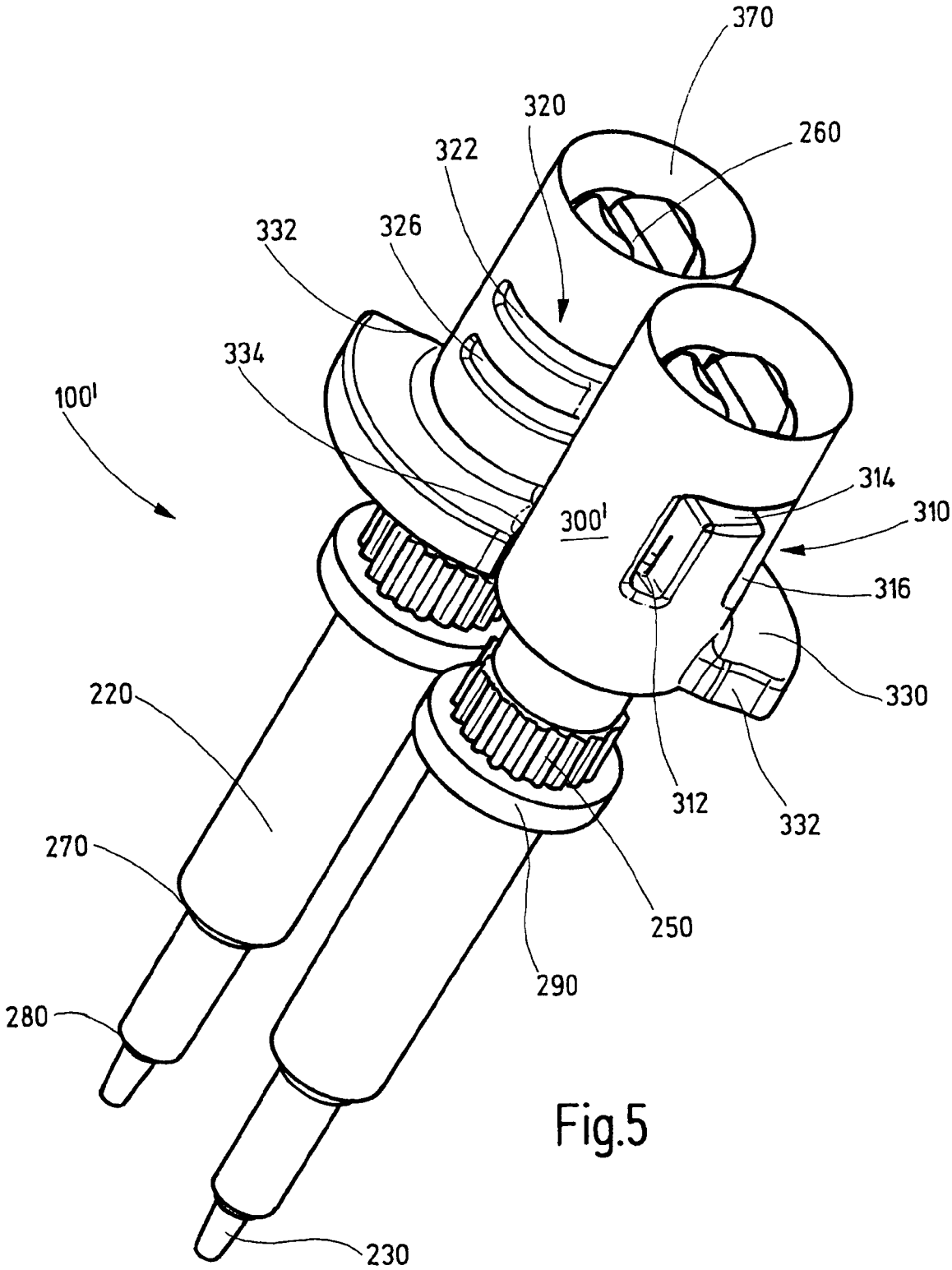
FIG. 5 a perspective view of a second embodiment of an adjustment means according to the present invention.

FIGS. 1A to 3E show a first embodiment of an adjustment means 100 for adjusting the fuel flow in a carburetor 400 (compare FIG. 4) of an internal combustion engine, namely a two-stroke motor or a four-stroke motor; and FIG. 5 shows a second embodiment of an adjustment means 100' for setting the fuel flow in a carburetor 400' (compare FIG. 6) of an internal combustion engine, namely a two-stroke motor or a four-stroke motor.

Figure 6:
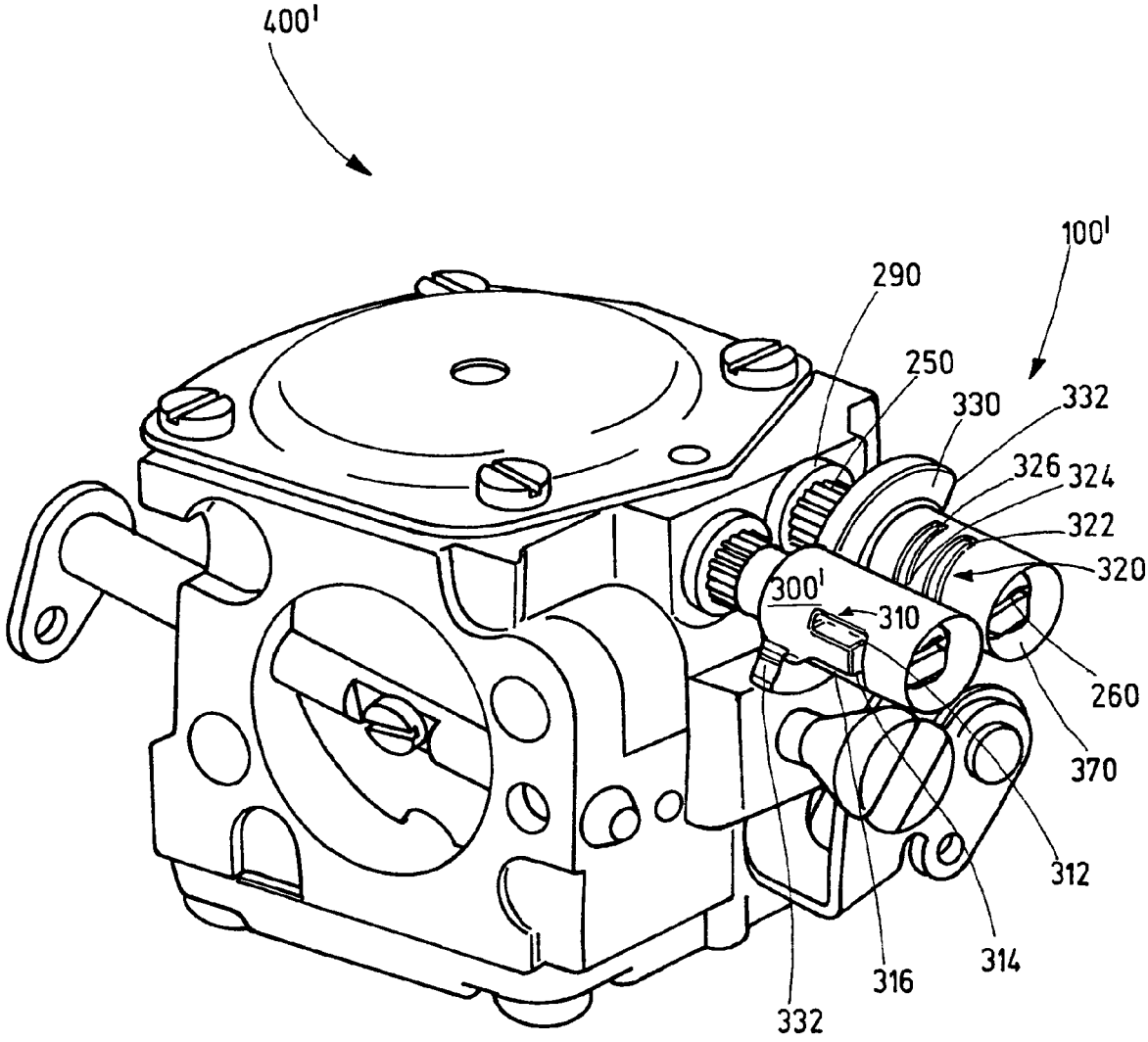
FIG. 6 a perspective view of a second embodiment of a carburetor in which the adjustment means of FIG. 5 is installed according to the first installation position.

To avoid unnecessary repetition, the following explanations concerning the embodiments, characteristics and advantages of the present invention relate to:

- both the first embodiment of the adjustment means 100 according to FIGS. 1A to 4; and
- to the second embodiment of the adjustment means 100' according to FIGS. 5 and 6.

The adjustment means 100 or 100' comprises two identical rotatable set screws 200, namely

- an idle adjusting screw or L(ow)-needle for setting the idle operation (<--> lean fuel/air mixture) as well as

- a load setting screw or H(igh)-needle for setting the full or partial load operation (<--> rich fuel/air mixture)

with a respective screw head 210 and a respective screw needle or valve needle 220, which are arranged side by side.

These set screws or adjustment screws 200 are used for precise and quick setting of the fuel flow through the carburetor 400 (=first embodiment according to FIG. 4) or 400' (=second embodiment according to FIG. 6) with the use of fully automatically operating measuring cabins.

On the side facing away from the screw needle or valve needle 220 of the screw head 210, there is a slot 260 which conically tapers off towards the side of the screw needle or screw tip (compare FIG. 1A, FIG. 1B, FIG. 2, FIG. 4, FIG. 5 and FIG. 6), wherein said slot 260 extends across the diameter of the screw head 210, which diameter is for example approximately 4.5 millimetres, with said slot being provided to accept an electronically controlled screwdriver.

The adjustment means 100 (=first embodiment) shown in FIGS. 1A to 3E as well as the adjustment means 100' (=second embodiment) shown in FIG. 5 furthermore comprises two uniform limiter caps 300 and 300', i.e. an identical cap is provided for each needle. Each of the limiter caps 300 and 300' is seated on one of the screw needles 220, in this way enclosing the screw needle 220 on approximately a third of its length, essentially in a positive-locking manner.

Since the set screws 200 both in the first embodiment (compare FIGS. 1A to 4) and in the second embodiment (compare FIGS. 5 and 6) are arranged directly side by side, the limiter caps 300 and 300' at their area facing the respective adjacent set screw 200 are in contact with each other.

Each of the limiter caps 300 or 300' is attached to the screw needle 220 in such a way that the screw head 210 protrudes from the end region 360 of the limiter cap 300 or 300', which end region faces away from the screw needle 220. In this way unintended pressing against the limiter cap 300 or 300' during adjustment of the valve needle or the screw needle 220 with the use of a tool, for example a screwdriver, is prevented.

In a way which is significant in the context of the invention, this prevents the limiter cap 300 or 300' from inadvertently being pushed or clipped onto the screw needle or valve needle 220 already at the time when the carburetor 400 or 400' is adjusted, and thus prevents premature blocking of said screw needle or valve needle 220.

The limiting cap 300 or 300' is positioned or attached to the set screw 200 without any further auxiliary means or without any further supplementary part, for example without any further retaining clip, in a way so as to be self-attaching, and is designed in such a way that the limiter caps 300 and 300' can engage each other with locking action.

Figure 1A:
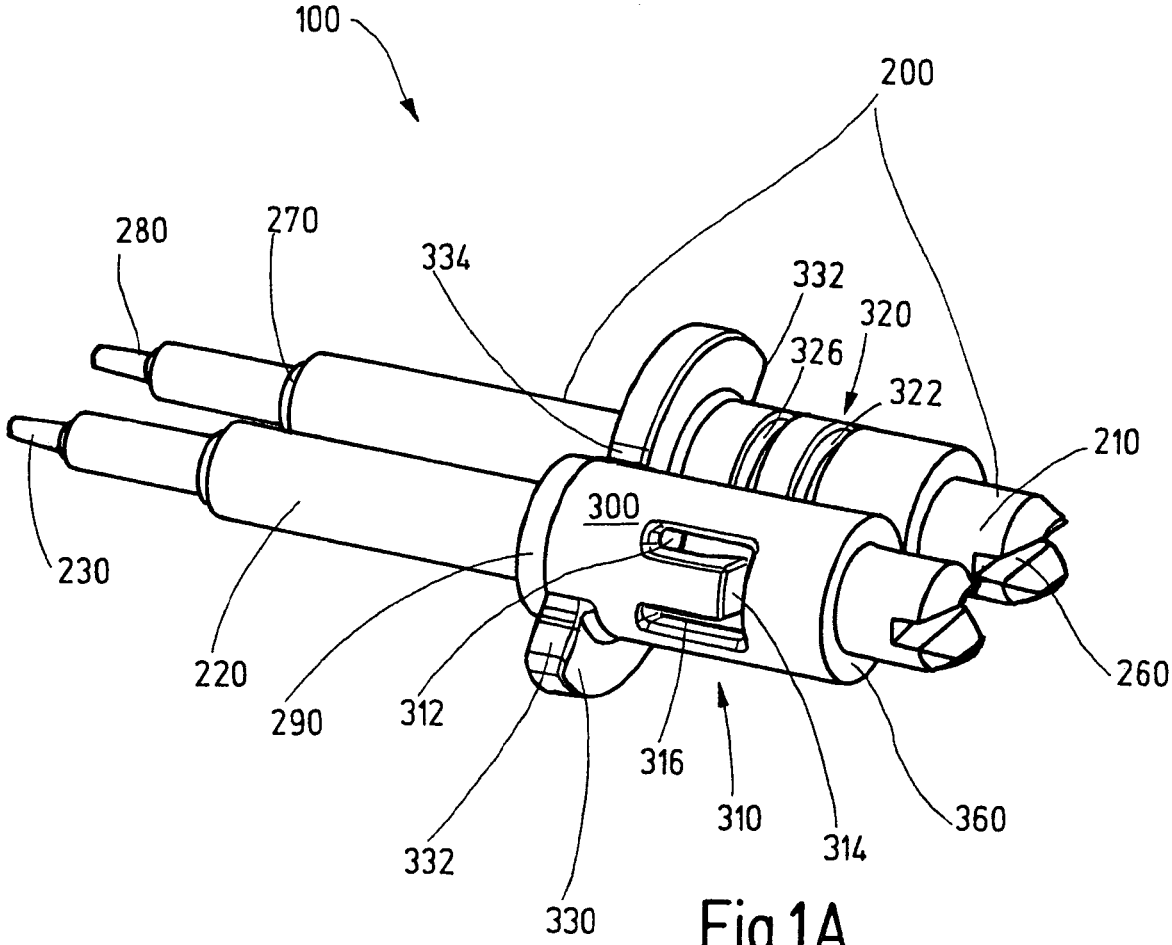
FIG. 1A a perspective view of a first embodiment of an adjustment means according to the present invention.
Figure 3A:
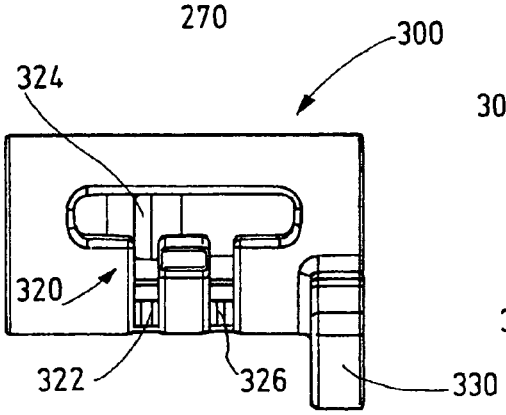
FIG. 3A a lateral view of an embodiment of a limiter cap which is associated with the adjustment means shown in FIG. 1A to FIG. 1D and which is designed to interact with the set screw shown in FIG. 2.
Figure 3B:
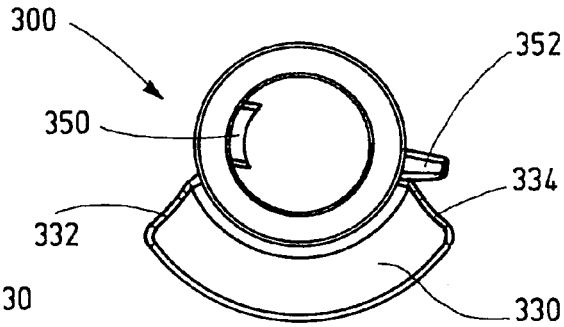
FIG. 3B a top view of the limiter cap shown in FIG. 3A.
Figure 3C:
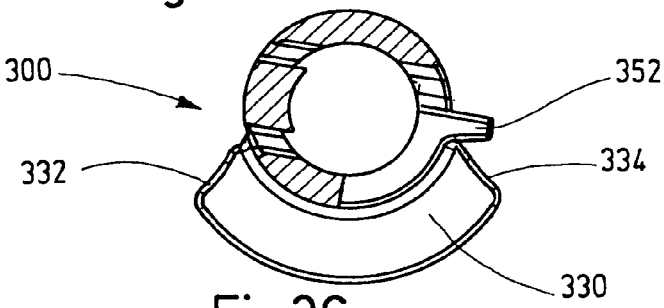
FIG. 3C a cross-sectional view of the limiter cap shown in FIG. 3A and in FIG. 3B.
Figure 3D:
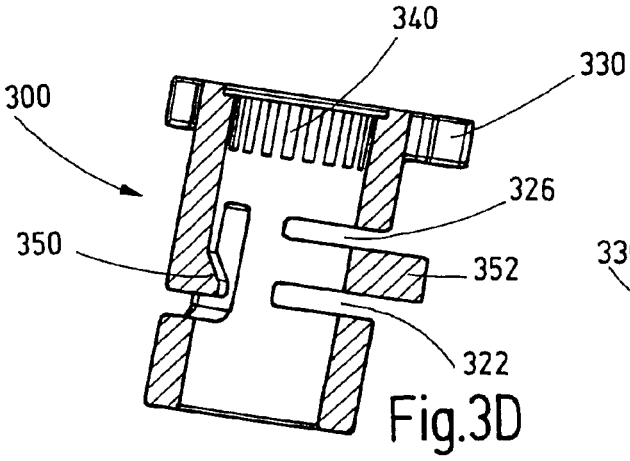
FIG. 3D a longitudinal section view of the limiter cap shown in FIG. 3A, FIG. 3B and FIG. 3C.
Figure 3E:
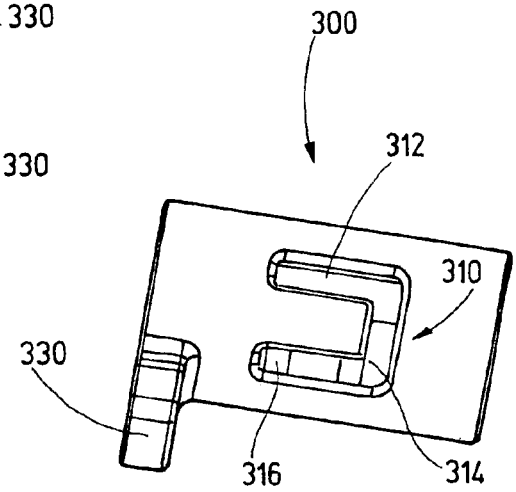
FIG. 3E a further lateral view of the limiter cap shown in FIG. 3A, FIG. 3B, FIG. 3C and FIG. 3D.

The limiter cap 300 or 300' comprises a U-shaped recess 310 (compare FIG. 1A and FIG. 3E). This U-shaped recess 310 extends along approximately half the length of the limiter cap 300 or 300' and is arranged approximately in the middle in relation to the longitudinal extension of the limiter cap 300 or 300'.

The first limb 312 of the recess 310, which is the upper limb in FIG. 3E, and the second limb 316 of the recess 310, which is the lower limb in FIG. 3E, extend essentially parallel to the screw needle or valve needle 220. The web 314, which interconnects these two limbs 312, 316, of the first recess 310 essentially extends perpendicularly to the screw needle or valve needle 220.

Furthermore, the limiter cap 300 or 300' comprises a recess 320 (compare FIG. 1A, FIG. 3A as well as FIG. 3D) The first parallel groove 322 of this recess 320, which parallel groove is located closer to the screw head 210, and the second parallel groove 326 of this recess 320, which parallel groove is located closer to the needle tip, essentially extend perpendicularly in relation to the valve needle or screw needle 220. The connection groove 324 of the recess 320, which connection groove interconnects these two parallel grooves 322, 326, essentially extends parallel to the valve needle or screw needle 220.

In the transition region, facing the needle tip 230 between the limiter cap 300 or 300' and the screw needle or valve needle 220, the limiter cap 300 or 300' comprises a ring-shaped adjustment prevention device 330 which extends around somewhat more than a quarter of the external circumference of the limiter cap 300 or 300' (compare FIGS. 1A to 1D as well as FIGS. 3A to 3E).

This adjustment prevention device 330 is essentially oriented perpendicularly to the longitudinal extension of the limiter cap 300 or 300', wherein the width of the adjustment prevention device 330 corresponds to approximately half of the diameter of the screw head 210; at each of its two lateral end regions, the adjustment prevention device comprises an end stop 332, 334.

Figure 1B:
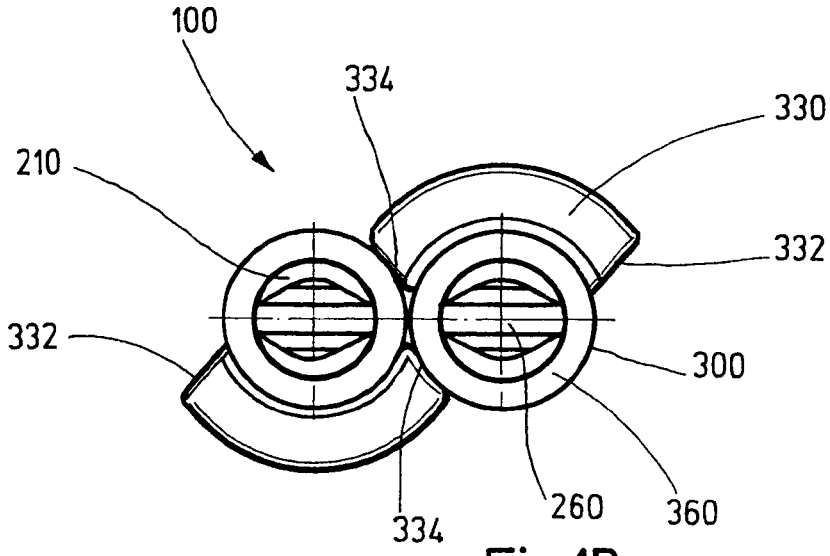
FIG. 1B a top view of the adjustment means shown in FIG. 1A.

The adjustment prevention device 330 of the set screw or valve needle 200 shown in the foreground in FIG. 1A, and on the left in FIG. 1B, is rotated by 180 degrees in relation to the adjustment prevention device 330 of the set screw or valve needle 200 which is shown in the background in FIG. 1A, and on the right in FIG. 1B, so that there is a diametrically offset arrangement of the two adjustment prevention devices 330 which are in the shape of a quarter of a circle to a third of a circle.

Due to the arrangement of the two set screws 200 shown in the two embodiments according to the present invention, as well as the arrangement of the two adjustment prevention devices 330 shown in the two embodiments according to the present invention, the adjustment prevention device 330 limits the adjustment range of the set screw or valve needle 200, as long as the set screw or valve needle 200 is connected to the limiter cap 300 or 300' so as to be nonrotatable.

The set screw or valve needle 200 comprises a spring support 290 with an exemplary diameter of approximately six millimetres; wherein this spring support 290 is located closer to the needle tip 230 than is the adjustment prevention device 330.

Figure 1C:
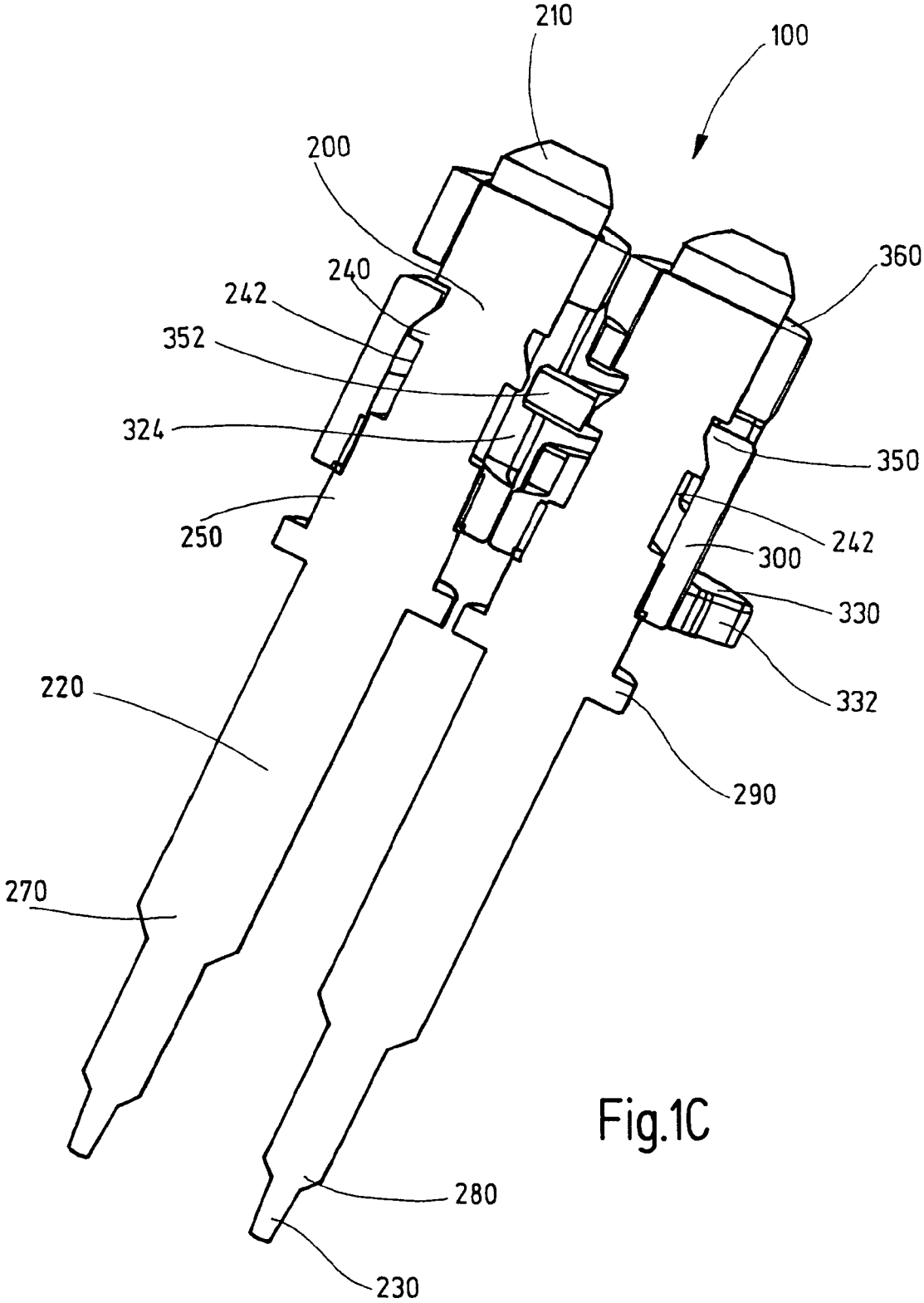
FIG. 1C a longitudinal section view of the adjustment means shown in FIG. 1A and in FIG. 1B in a first installation position (so-called first snap-in position)
Figure 1D:
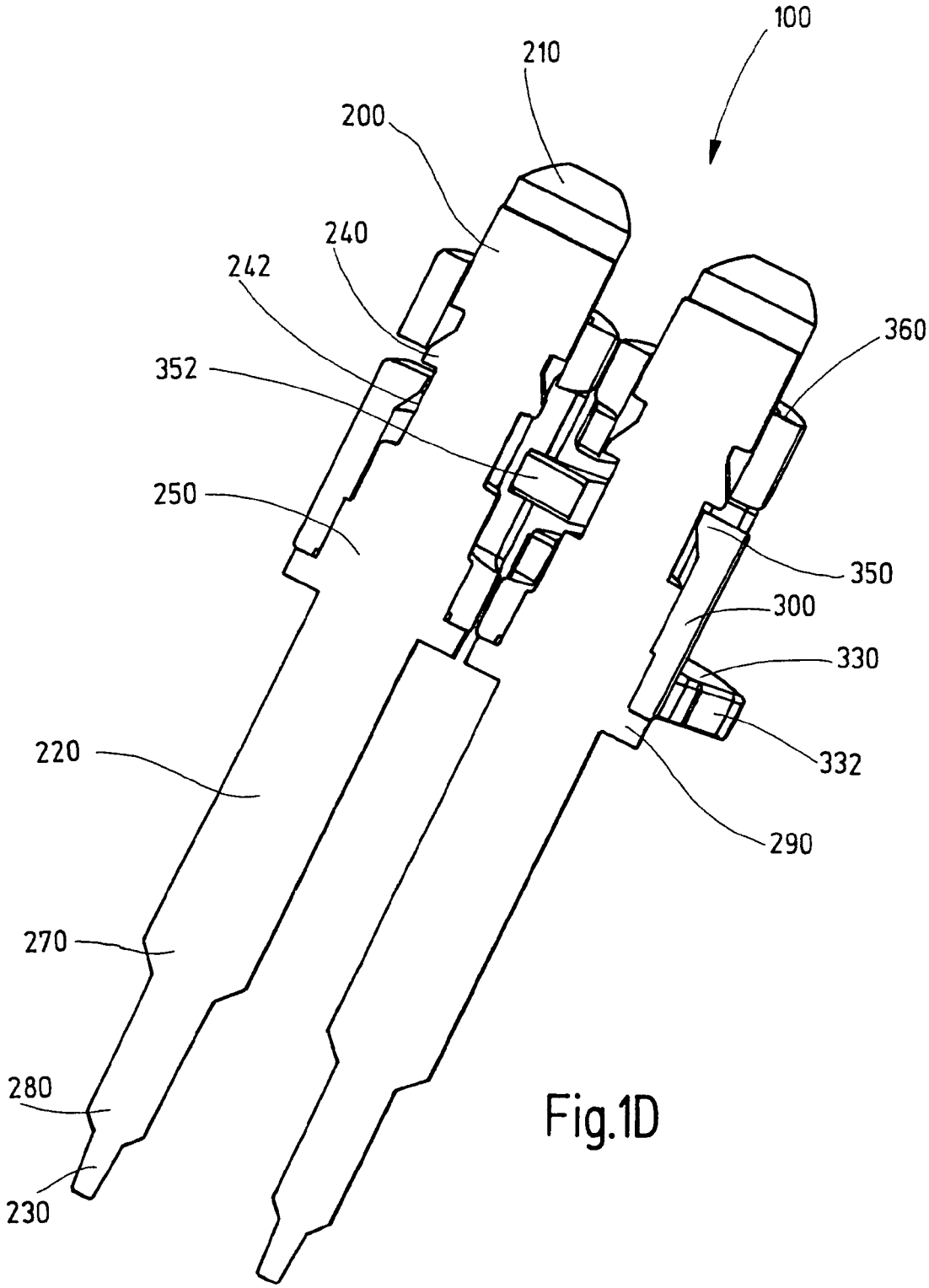
FIG. 1D a longitudinal section view of the adjustment means shown in FIG. 1A and in FIG. 1B in a second installation position (so-called second snap-in position)
Figure 2:
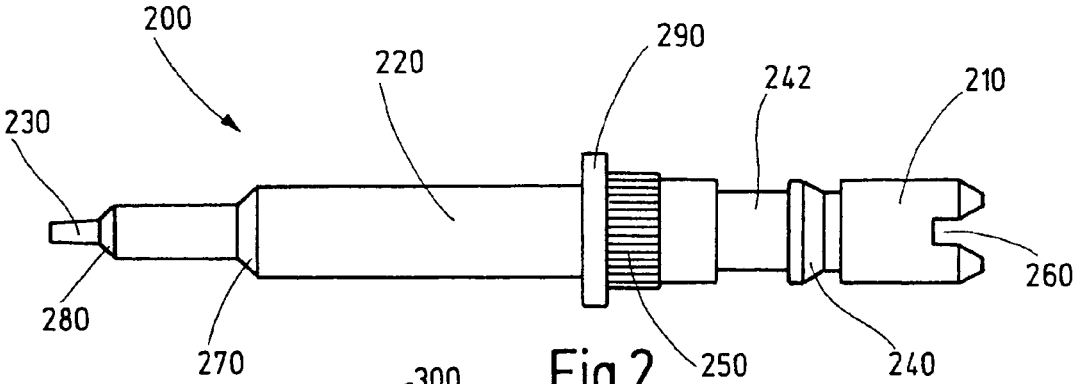
FIG. 2 a lateral view of an embodiment of a set screw which is associated with the adjustment means shown in FIG. 1A to FIG. 1D.

As shown in the drawings in FIG. 1A, in FIG. 1C, in FIG. 1D and in FIG. 2 (=first embodiment of the adjustment means 100), or in FIG. 5 (=second embodiment of the adjustment means 100')

the screw needle 220 tapers off in two stages towards its needle point 230.

The first section of the screw needle or valve needle 220, which section is situated between the spring support 290 and the first stage 280 of the screw needle 220, has an exemplary diameter of approximately four millimetres; the second section of the screw needle 220, which section is situated between the first stage 270 of the screw needle 220 and the second stage 280 of the screw needle 220, has an exemplary diameter of approximately three millimetres; while the needle point 230 has an exemplary diameter of approximately one millimetre.

FIG. 1C shows the adjustment means 100 from FIGS. 1A and 1B (or the adjustment means 100' from FIG. 5) in a first installation position or in a first snap-in position. In this first installation position, an inward pointing projection 350, which is arranged on the interior circumference of the limiter cap 300 or 300', rests against a stop leg or a retaining nose 240 (compare also FIG. 2) of the screw needle or valve needle 220, thus preventing axial movement of the limiter cap 300 or 300' in the direction of the needle point 230.

In this way a premature and inadvertent transition of the limiter cap 300 or 300' from the first installation phase (compare FIG. 1C) to the second installation phase (compare FIG. 1D) is prevented.

The longitudinal section views of FIG. 1C and FIG. 1D clearly show that the two limiter caps 300 or 300' are in contact with each other at their surface facing the respective adjacent set screw 200. At this contact surface, the limiter cap 300 or 300', in particular the limiter cap attached to the left set screw 200 in the FIGS. 1C and 1D, comprises a connection groove 324 (compare also FIG. 3A).

This connection groove 324 interacts with a guiding nose 352 (compare also FIGS. 3B, 3C and 3D) of the adjacent limiter cap 300 or 300', in particular of the limiter cap 300 or 300' attached to the right set screw 200 in FIGS. 1C and 1D.

This means that in the first installation position (compare FIG. 1C) the guiding nose 352, which is designed in a way that is significant in the context of the invention, rests against the stop leg or the retaining nose 240 of both adjacent set screws 200. FIG. 2 shows that the stop leg or the retaining nose 240 extends in a ring shape around the external circumference of the screw needle or valve needle 220 and is arranged in the transition area between the screw head 210 and the screw needle or valve needle 220.

In the first installation position, the guiding nose 352 is thus spread apart outward by the retaining nose 240 so that the guiding nose 352 of the right limiter cap 300 in FIG. 1C engages the connection groove 324 of the other limiter cap, in other words of the limiter cap shown on the left in FIG. 1C.

By means of this measure, which is significant in the context of the invention, the caps 300, 300' cannot rotate or move out of adjustment when the needles 220 are rotated or adjusted. The caps 300, 300' thus rest against each other at the contact position of the two guiding noses 352 as well as resting against the contact position of the adjustment prevention devices 330 of the limiter caps 300, 300' with the respective other cap 300, 300'.

In this way the limiter cap 300 or 300' is attached in a captive way to the set screw 200, and the set screw 200 is rotatable relative to the limiter cap 300 or 300'. This means that the needle 220 is rotatable without the cap 300, 300' rotating with it.

If the limiter cap 300 or 300' is pushed further in the direction of the needle points 230 (=transition from the first installation state according to FIG. 1C to the second installation state according to FIG. 1D), then the inward pointing projection 350 of the limiter cap 300 or 300' is pushed over the stop leg or the retaining nose 240 into a groove 242 of the screw needle 200, and the limiter cap 300 or 300' is moved in axial direction until the limiter cap 300 or 300' essentially rests against the spring support 290 of the set screw 200.

The position of the limiter cap 300 or 300' corresponds to its second installation position, or its second snap-in position, as shown in FIG. 1D.

As a result of the interaction between the guiding nose 352, which is significant in the context of the invention, (compare also FIGS. 3B, 3C and 3D) of one limiter cap and the relief 320 (compare also FIG. 1A as well as FIGS. 3A and 3D) of the other limiter cap, the rotary movement of the two screws 200, as well as the independent transition of the two screws 200 from the first installation position to the second installation position, is made possible.

Thus in the second installation position the guiding nose 352 jumps back below the stop leg or the retaining nose 240 and enters the connection groove 324 either slightly or no longer at all. The caps 300, 300' are thus unlocked and can be adjusted according to the adjustment options of the adjustment prevention device 330.

In this second installation position the limiter cap 300 or 300' interacts by way of a serration profile or a knurl 250 (compare also FIG. 2) of the screw needle or valve needle 220 with a complementary serration profile or complementary knurl 340 (compare also FIG. 3D) of the limiter cap 300 or 300' so that the limiter cap 300 or 300' in its second installation position is connected to the set screw 200 and in particular to the screw needle 220 in a way that is secure against rotation and loss, namely it is locked or snapped-in.

Since the inward pointing projection of the limiter cap 300, 300' cannot be removed from the groove 242 of the set screw 200 without damage, the limiter cap 300, 300' is connected to the screw needle in a way so that it is secure against loss.

In this (second) installation position the set screw or adjusting screw 200 can thus only be rotated within the framework of a specified adjustment angle because the adjustment prevention device 330 limits the adjustment travel of the adjusting screw 200.

As shown in FIG. 4 or in FIG. 6, the adjustment means 100 or 100' and in particular the set screw 200 in its interaction with the limiter cap 300 or 300' are primarily used to adjust the fuel flow through the carburetor 400 or 400'. This carburetor 400 or 400' is associated with the two-stroke or four-stroke motor of a tool or item of work equipment, for example a small vehicle, a motor (chain) saw, a brush cutter or a lawnmower.

The second embodiment (compare FIGS. 5 and 6) differs from the first embodiment (compare FIGS. 1A to 4) essentially in that the second embodiment additionally comprises a leading-in aid 370, in particular for an electronically controlled tool, for example a screwdriver.

This leading-in aid 370 is attached to the side of the limiter cap 300', which side faces away from the screw needle or valve needle 220, and can be designed as a funnel or, as shown in FIGS. 5 and 6, as a leading-in land.

List of Reference Characters

100 Adjustment means (first embodiment; compare FIGS. 1A to 4)
100' Adjustment means (second embodiment; compare FIGS. 5 and 6)
200 Set screw or valve
210 Screw head of the set screw or of the valve 200
220 Screw needle of the set screw or valve needle of the valve 200
230 Needle tip of the screw needle or valve needle 220
240 Retaining nose or stop leg of the screw needle or valve needle 220
242 Groove of the screw needle or valve needle 220
250 Locking means, in particular serration profile, knurl or the like, of the screw needle or valve needle 220
260 Slot of the screw head 210
270 First stage of the screw needle or valve needle 220
280 Second stage of the screw needle or valve needle 220
290 Spring support of the screw needle or valve needle 220
300 Limiter cap (first embodiment; compare FIGS. 1A to 4)
300' Limiter cap (second embodiment; compare FIGS. 5 and 6)
310 In particular U-shaped recess of the limiter cap 300
312 First limb of the recess 310
314 Web of the recess 310
316 Second limb of the recess 310
320 Relief of the limiter cap 300
322 First parallel groove of the relief 320
324 Connection groove of the recess 320
326 Second parallel groove of the recess 320
330 Adjustment prevention device of the limiter cap 300
332 First end stop of the adjustment prevention device 330
334 Second end stop of the adjustment prevention device 330
340 Complementary locking means, in particular complementary serration profile, complementary knurl or the like, of the limiter cap 300
350 Inward pointing projection of the limiter cap 300
352 Guiding nose of the limiter cap 300
360 End region of the limiter cap 300
370 Leading-in aid, in particular funnel or leading-in land, in particular for an electronically controlled tool
400 Carburetor (first embodiment; compare FIG. 4)
400' Carburetor (second embodiment; compare FIG. 6)

The invention claimed is:

1. A limiter cap (300; 300') for limiting the adjustability of at least two set screws or valves (200), which are arranged side by side, with each set screw or valve (200) comprising at least one retaining nose or stop leg (240), which in the transition area between the screw head (210) and the screw needle or valve needle (220) extend in a ring shape around the outer circumference of the screw needle or valve needle (220), for limiting the adjustment of the fuel flow through a carburetor (400; 400'), wherein said limiter cap (300; 300')
- can be attached to any of the set screws (200);
- comprises at least one adjustment prevention device (330), comprising at least one end stop (332, 334);
- can be attached to the set screw (200) so that the limiter cap (300; 300') surrounds at least a region of the set screw (200) essentially so as to be positive-locking; and
- in a first installation position, in which the set screw (200) can be rotated relative to the limiter cap (300; 300'), can be attached in a captive way to the set screw (200); and
- in a second installation position can be locked in a captive way to the set screw (200) by way of at least one locking means (250), by way of at least one serration profile, by way of at least one knurl;

characterised in that
- attachment of the limiter cap (300; 300') on each of the set screws (200) takes place
  - in a self-attaching manner and/or
  - such that the limiter caps (300; 300') snap into each other, and/or
  - without any further auxiliaries or supplementary parts; and
- that each of the limiter caps (300; 300') comprises at least one guiding nose (352) and at least one connection groove (324) such that
  - in the first installation position, the guiding nose (352) of one limiter cap (300 or 300') engages the connection groove (324) of the other limiter cap (300' or 300) which is attached to the adjacent set screw (200); and
  - in the second installation position the guiding nose (352) jumps back below the stop leg or the retaining nose (240).

2. The limiter cap according to claim 1, characterised in that by the guiding nose (352) of one limiter cap (300 or 300') engaging the connection groove (324) of the other limiter cap (300' or 300)
- the limiter caps (300; 300') cannot be rotated or adjusted; and/or
- the limiter caps (300; 300') can be brought from the first installation position to the second installation position independently of each other.

3. The limiter cap according to claim 1, characterised in that in the first installation position
- the guiding nose (352) of one limiter cap (300 or 300') is spread apart by the retaining nose (240) of the set screw (200) in such a way that this guiding nose (352) rests against the respective stop leg or against the respective retaining nose (240) of both adjacent set screws (200); and/or
- the limiter caps (300; 300') rest against each other at the contact position of the two guiding noses (352) as well as resting against the contact position of the two adjustment prevention devices (330) of the limiter caps (300; 300') with the respective other limiter cap (300' or 300).

4. The limiter cap according to claim 3, characterised in that in the second installation position the guiding nose (352) engages the connection groove (324) either slightly or no longer at all; and the limiter caps (300; 300') are rotatable or adjustable according to the adjustment options of the adjustment prevention devices (330).

5. The limiter cap according to claim 3, characterised by at least one projection (350) which is arranged at the internal circumference of the limiter cap (300; 300') and which points inward, wherein said projection (350) in the first installation position, by interaction with and by resting against the retaining nose (240) prevents any axial movement of the limiter cap (300; 300') in the direction of the tip (230) of the screw needle or valve needle (220), and thus prevents any premature and unintended transition of the limiter cap (300; 300') from the first installation position to the second installation position.

6. The limiter cap (300') according to claim 5, characterised by at least one leading-in aid (370), comprising a leading-in funnel, leading-in land or leading-in ring, for an electronically controlled tool, comprising a screwdriver, wherein said leading-in aid (370) is arranged on the side of the limiter cap (300; 300'), which side faces away from the screw needle or valve needle (220).

7. The limiter cap according to claim 6, characterised in that the locking means (250) of the screw needle or valve needle (220) in the second installation position interacts with at least one complementary locking means (340), with at least one complementary serration profile, with at least one complementary knurl, of the limiter cap (300; 300'), with the complementary locking means (340) of the limiter cap (300; 300').

8. An adjustment means (100; 100'), for setting the fuel flow through a carburetor (400; 400'), comprising at least two rotatable set screws or valves (200) arranged side by side each comprising a screw head (210) and each comprising a screw needle or valve needle (220) as well as at least two limiter caps (300; 300') according to claim 1, characterised in that the screw head (210) projects from the end region (360) of the limiter cap (300; 300') facing away from the screw needle or valve needle (220) so that the respective set screw (200) in the first installation phase cannot be locked to the respective limiter cap (300; 300'); and in that the limiter caps (300; 300') are of uniform design and can be clipped onto or snapped to any of the set screws (200).

9. The adjustment means according to claim 8, characterised in that the set screws (200) are designed as at least one idle adjusting screw or L(ow)-needle; and as at least one load setting screw or H(igh)-needle.

10. A carburetor (400; 400') associated with a two-stroke motor or a four-stroke motor, characterised by at least two limiter caps (300; 300') according to claim 1 and/or at least one adjustment means (100; 100') according to claim 8.

11. An internal combustion engine, comprising a two-stroke motor or four-stroke motor, characterised by at least one carburetor (400; 400') according to claim 10.

12. Tools or work equipment, comprising a small vehicle, a motor (chain) saw, a brush cutter or a lawnmower, characterised by at least one internal combustion engine according to claim 11.

13. The use of at least one limiter cap (300; 300') according to claim 1, in at least one tool or item of work equipment, comprising at least one small vehicle, at least one motor (chain) saw, at least one brush cutter or at least one lawnmower.

14. A method for adjusting the fuel flow through a carburetor (400; 400') wherein (i) the carburetor (400; 400') is provided with at least two rotatable set screws or valves (200), arranged side by side, for preadjusting the fuel throughflow by rotating the screw needle (220), which projects from the carburetor (400; 400'), of the respective set screw (200) or of the valve shaft of the respective valve which valve shaft projects from the carburetor (400; 400');

(ii) in a first installation phase for preadjusting the carburetor (400; 400'), the respective set screw (200) is rotated relative to at least one limiter cap (300; 300') which encloses at least a region of the respective set screw (200) in an essentially positive manner and in a captive manner on each of the set screws (200);

in a self-attaching manner and/or in such a way that the limiter caps (300; 300') snap into each other; and/or without any further auxiliary or supplementary part so as to adjust the fuel flow to a specified desired value, wherein the respective limiter cap (300; 300') is clipped to or locked to the respective set screw (200), and the screw head (210) of the respective set screw (200) projects from the end region (360) facing away from the screw needle (220) or valve needle of the respective limiter cap (300; 300') so that the respective set screw (200) in the first installation phase cannot be locked to the respective limiter cap (300; 300'), and (iii) in a second installation phase the respective limiting cap (300; 300') can be locked in a captive way to the respective set screw (200) by way of at least one locking means (250), by way of at least one serration profile, by way of at least one knurl, so that any adjustment or readjustment option is only possible within the framework of an adjustment angle which is determined by an adjustment prevention device (330), of which there is at least one, associated with the limiter cap (300; 300'), comprising at least one end stop (332, 334).

* * * * *